US010775828B1

(12) United States Patent
Lee

(10) Patent No.: US 10,775,828 B1
(45) Date of Patent: Sep. 15, 2020

(54) REFERENCE VOLTAGE GENERATION CIRCUIT INSENSITIVE TO ELEMENT MISMATCH

(71) Applicant: Shanghai Zhaoxin Semiconductor Co., Ltd., Shanghai (CN)

(72) Inventor: Yeong-Sheng Lee, Fremont, CA (US)

(73) Assignee: SHANGHAI ZHAOXIN SEMICONDUCTOR CO., LTD., Shanghai (CN)

( * ) Notice: Subject to any disclaimer, the term of this patent is extended or adjusted under 35 U.S.C. 154(b) by 0 days.

(21) Appl. No.: 16/429,401

(22) Filed: Jun. 3, 2019

(51) Int. Cl.
*G05F 3/26* (2006.01)

(52) U.S. Cl.
CPC ..... *G05F 3/267* (2013.01)

(58) Field of Classification Search
CPC ..... G05F 3/26
See application file for complete search history.

(56) References Cited

U.S. PATENT DOCUMENTS

| | | | | |
|---|---|---|---|---|
| 6,507,179 | B1 * | 1/2003 | Jun | G05F 3/30 323/313 |
| 10,061,340 | B1 * | 8/2018 | Rao | H03F 3/04 |
| 10,310,528 | B1 * | 6/2019 | Elsayed | G05F 1/565 |
| 2007/0146047 | A1 * | 6/2007 | Senriuchi | G01D 3/036 327/512 |
| 2009/0146730 | A1 * | 6/2009 | Chen | G05F 3/30 327/539 |
| 2010/0156366 | A1 * | 6/2010 | Sakai | H02M 3/1588 323/282 |

* cited by examiner

*Primary Examiner* — Jue Zhang
*Assistant Examiner* — Trinh Q Dang
(74) *Attorney, Agent, or Firm* — McClure, Qualey & Rodack, LLP

(57) ABSTRACT

A reference voltage generation circuit for generating an output voltage is provided. The reference voltage generation circuit includes a bandgap reference circuit and a voltage adjustment circuit. The bandgap reference circuit generates the output voltage at an output node and a reference voltage. The voltage adjustment circuit is coupled to the bandgap reference circuit. The voltage adjustment circuit receives the output voltage and the reference voltage, compares the output voltage with the reference voltage to generate a comparison result, and adjusts the output voltage according to the comparison result.

22 Claims, 4 Drawing Sheets

$$\frac{Q2}{Q1} = \frac{2\times n\times A}{A} = 2\times n$$

$$\frac{Q2a}{Q1a} = \frac{2A}{A} = 2$$

$$\frac{Q2}{Q2a} = \frac{2\times n\times A}{2\times A} = n$$

REFERENCE VOLTAGE GENERATION CIRCUIT INSENSITIVE TO ELEMENT MISMATCH

BACKGROUND OF THE INVENTION

Field of the Invention

The invention relates to a reference voltage generation circuit, and, more particularly, to a reference voltage generation circuit which is insensitive to element mismatch.

Description of the Related Art

Integrated circuits often require a reference voltage which remains stable under PVT (process, voltage, temperature) variations. A bandgap reference circuit is provided to generate a reference voltage which is not varied with the temperature variation. However, a reference voltage generated by a bandgap reference circuit may vary due to mismatch between elements induced by process variations, such as mismatch between metal-oxide-semiconductor (MOS) transistors of a current mirror circuit within the bandgap reference circuit. Thus, it is desired to provide a bandgap reference circuit which is insensitive to the element mismatch.

BRIEF SUMMARY OF THE INVENTION

An exemplary embodiment of a reference voltage generation circuit for generating an output voltage is provided. The reference voltage generation circuit comprises a bandgap reference circuit and a voltage adjustment circuit. The bandgap reference circuit generates the output voltage at an output node and a reference voltage. The voltage adjustment circuit is coupled to the bandgap reference circuit. The voltage adjustment circuit receives the output voltage and the reference voltage, compares the output voltage with the reference voltage to generate a comparison result, and adjusts the output voltage according to the comparison result.

Anther exemplary embodiment of a reference voltage generation circuit is provided for generating an output voltage at an output node. The reference voltage generation circuit comprises a first bipolar transistor, a second bipolar transistor, a first resistor, a second resistor, a third resistor, a first operational amplifier, and a voltage adjustment circuit. The first bipolar transistor has a base coupled to a ground terminal, a collector coupled to the ground terminal, and an emitter coupled to a first node. The second bipolar transistor has a base coupled to the ground terminal, a collector coupled to the ground terminal, and an emitter coupled to a second node. The first resistor is coupled between the second node and a third node. The second resistor is coupled to the output node and the first node. The third resistor is coupled to a reference node and the third node. The first operational amplifier has a non-inverting input terminal coupled to the third node, an inverting input terminal coupled to the first node, and an output terminal. The first current mirror circuit is coupled to a voltage source and further coupled to the output node and the reference node. The voltage adjustment circuit is coupled to the output node and the reference node to receive the output voltage and a reference voltage respectively. The voltage adjustment circuit compares the output voltage with the reference voltage to generate a comparison result and adjusts the output voltage according to the comparison result.

Another exemplary embodiment of a reference voltage generation circuit is provided for generating an output voltage at an output node. The reference voltage generation circuit is provided comprises a first bipolar transistor, a second bipolar transistor, a first resistor, a second resistor, a third resistor, an operational amplifier, a fourth resistor, a fifth resistor, a sixth resistor, a current mirror circuit, a first voltage adjustment circuit, and a second voltage adjustment circuit. The first bipolar transistor has a base coupled to a ground terminal, a collector coupled to the ground terminal, and an emitter coupled to a first node. The second bipolar transistor has a base coupled to the ground terminal, a collector coupled to the ground terminal, and an emitter coupled to a second node. The first resistor is coupled between the second node and a third node. The second resistor is coupled to a first reference node and the first node. The third resistor is coupled to a second reference node and the third node. The operational amplifier has a non-inverting input terminal coupled to the third node, an inverting input terminal coupled to the first node, and an output terminal. The fourth resistor is coupled between the third node and the ground terminal. The fifth resistor is coupled between a third reference node and the output node. The sixth resistor is coupled between the output node and the ground terminal. The current mirror circuit is coupled to a voltage source and further coupled to the first, second, and third reference nodes. The first voltage adjustment circuit is coupled to the first reference node and the second reference node to receive a first reference voltage and a second reference voltage respectively. The first voltage adjustment circuit compares the first reference voltage with the second reference voltage to generate a first comparison result and adjusts the first reference voltage according to the first comparison result. The second voltage adjustment circuit is coupled to the second reference node and the third reference node to receive the second reference voltage and a third reference voltage respectively. The second voltage adjustment circuit compares the second reference with the third reference voltage to generate a second comparison result and adjusts the output voltage according to the second comparison result.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
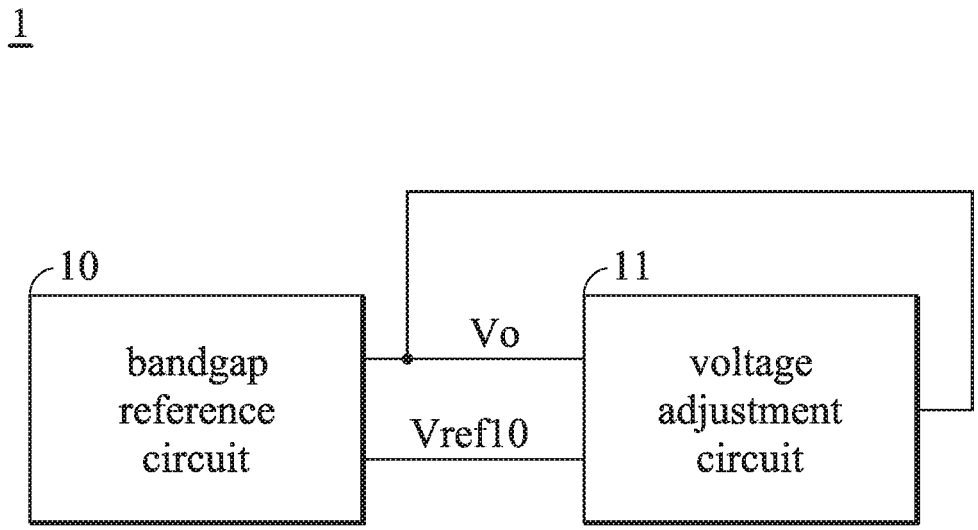
FIG. 1 shows an exemplary embodiment of a reference voltage generation circuit.

FIG. 1 shows an exemplary embodiment of a reference voltage generation circuit. Referring to FIG. 1, a reference voltage generation circuit 1 comprises a bandgap reference circuit 10 and a voltage adjustment circuit 11. The bandgap reference circuit 10 operates to generate an output voltage Vo which does not vary with temperature variation and serves as a reference voltage for integrated circuits (not shown) coupled to the reference voltage generation circuit 1. In ideal cases, the output voltage Vo should be equal to a predetermined value. However, in cases where mismatch between two elements, which are used to generate the output voltage Vo and the reference voltage Vref10 respectively, is occurred due to process variations, the output voltage Vo varies to be larger or less than the predetermined value when there is no compensation or adjustment operation. According to the embodiment, the bandgap reference circuit 10 further operates to generate a reference voltage Vref10 which also does not vary with temperature variations. The voltage adjustment circuit 11 receives the output voltage Vo and the reference voltage Vref10 and compares the output voltage Vo with the reference voltage Vref10. The voltage adjustment circuit 11 adjusts the output voltage Vo according to the comparison result, so that the output voltage Vo is eventually equal to the predetermined value. Thus, through the comparison and adjustment operations, the output voltage Vo is maintained at the predetermined value, that is, the output voltage is not disadvantageously affected by the element mismatch.

Figure 2:
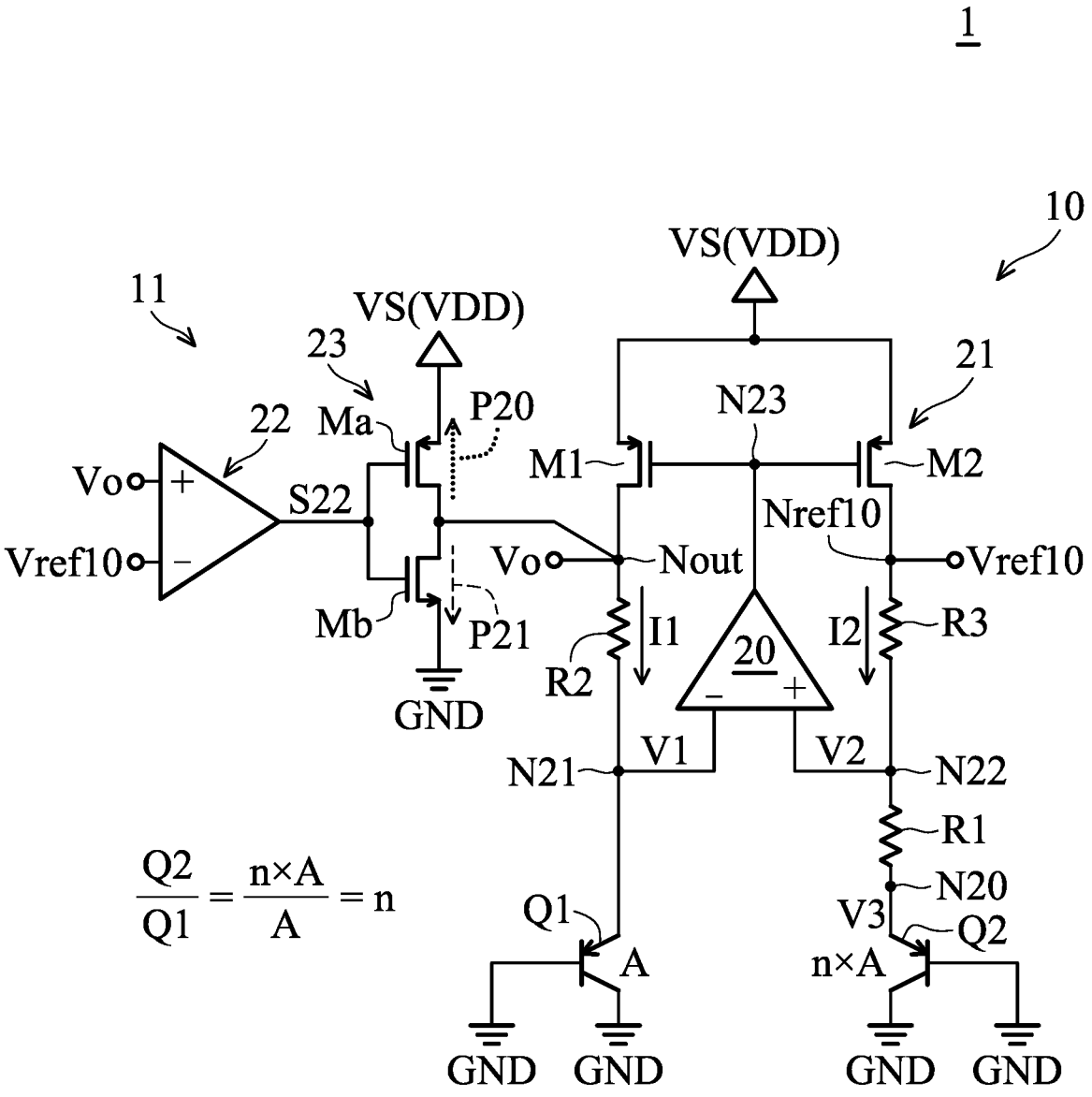
FIG. 2 shows another exemplary embodiment of a reference voltage generation circuit.

Referring to FIG. 2, in an exemplary embodiment of the reference voltage generation circuit 1, the bandgap reference circuit 10 comprises a pair of bipolar transistors Q1 and Q2, resistors R1-R3, an operational amplifier 20, and a current mirror circuit 21. The base of the bipolar transistor Q1 is coupled to a ground terminal GND, the collector thereof is coupled to the ground terminal GND, and the emitter thereof is coupled to a node N21. The base of the bipolar transistor Q2 is coupled to the ground terminal GND, the collector thereof is coupled to the ground terminal GND, and the emitter thereof is coupled to a node N20. In the embodiment of FIG. 2, the size of the bipolar transistor Q2 is n times the size A of the bipolar transistor Q1 (the size of the bipolar transistor Q2 is represented by n×A). In other words, the size ratio of the bipolar transistor Q2 and the bipolar transistor Q1 is equal to n, and the size ratio is represented by $$\frac{Q2}{Q1} = \frac{n \times A}{A} = n$$

in FIG. 2. In an example, n is a positive integer, for example, n is equal to 8 (n=8). The resistor R1 is coupled between a node N22 and the node N20. The resistor R2 is coupled between an output node Nout and the node N21. The resistor R3 is coupled to a reference node Nref10 and the node N22. In the embodiment, the resistance value of the resistor R2 is equal to the resistance value of the resistor R3. The non-inverting input terminal (+) of the operational amplifier 20 is coupled to the node N22, and the inverting input terminal (−) thereof is coupled to the node N21, and an output terminal thereof is coupled to the current mirror circuit 21 at a node N23. In the embodiment, the current mirror circuit 21 comprises metal-oxide-semiconductor (MOS) transistors M1 and M2. In the embodiment, the MOS transistors M1 and M2 are implemented by P-type MOS (PMOS) transistors. The gate of the PMOS transistor M1 is coupled to the node N23, the source thereof is coupled to a voltage source VS, and the drain thereof is coupled to the output node Nout. The gate of the PMOS transistor M2 is coupled to the node N23, the source thereof is coupled to the voltage source VS, and the drain thereof is coupled to the reference node Nref10. According to the structure of the current mirror circuit 21, the PMOS transistors M1 and M2 are controlled by the output at the output terminal of the operational amplifier 20. In the embodiment, the ratio of width to length of the PMOS transistor M1 is m times the ratio (W/L) of width to length of the PMOS transistor M2 (the ratio of width to length of the PMOS transistor M1 is represented by m(W/L)).

When the reference voltage generation circuit 1 receives a supply voltage VDD through the voltage source VS, the reference voltage generation circuit 1 operates. Based on the operation of the current mirror circuit 21 and the characteristic of the operational amplifier 20, currents I1 and I2 following respectively through the resistors R2 and R3 are generated, and the output voltage Vo and the reference voltage Vref10 are generated at the output node Nout and the reference node Nref10 respectively. Based on the operation of the reference voltage generation circuit 1, the current I2 is represented as:

$$I2 = \frac{V1 - V3}{R1} = \frac{\Delta V_{BE}}{R1} = \frac{V_T}{R1}\ln(nm) \qquad \text{Equation (1)}$$

wherein, V1 represents the voltage at the node N21, V3 represents the voltage at the node N20, $\Delta V_{BE}$ represents the difference between the base-emitter voltages of the bipolar transistors Q1 and Q2, and $V_T$ represents the threshold voltage of the bipolar transistors. The current I2 is proportional to absolute temperature (i.e. PTAT), that is, the current I2 has a positive temperature coefficient. Since the ratio of width to length of the PMOS transistor M1 is m times the ratio (W/L) of width to length of the PMOS transistor M2, the current I1 is m times the current I2, represented as:

$$I1 = m \times I2 \qquad \text{Equation (2)}$$

The current I1 is also proportional to absolute temperature. Then, the output voltage Vo is represented as:

$$Vo = V_{BE1} + I1 \times R2 = V_{BE1} + m \times \frac{V_T}{R1}\ln(nm) \times R2 \qquad \text{Equation (3)}$$

wherein, $V_{BE1}$ represents the base-emitter voltage of the bipolar transistor Q1, which is inversely proportional to absolute temperature (i.e. IPTAT). That is, the base-emitter voltage $V_{BE1}$ has a negative temperature coefficient. Due to the PTAT current I1 and the IPTAT base-emitter voltage $V_{BE1}$, the output voltage Vo has a zero temperature coefficient.

In cases (ideal cases) where there is no mismatch between the PMOS transistors M1 and M2 (that is, m=1), Equation (3) is re-written as:

$$Vo = V_{BE1} + I1 \times R2 = V_{BE1} + \frac{V_T}{R1}\ln(n) \times R2 \qquad \text{Equation (4)}$$

In these ideal cases, the current I1 is equal to the current I2, and, thus, both of the output voltage Vo and the reference voltage Vref10 are equal to a predetermined value, such as 1.25 volts (V). However, in some situations, mismatch may occur between the PMOS transistors M1 and M2 due to process variations, which means that m is larger than or less than 1 (m>1 or m<1). In these cases, the current I1 becomes not equal to the current I2, so that the output voltage Vo is not equal to the reference voltage Vref10, and the output voltage Vo is also not equal to the predetermined value.

According to the embodiment, the voltage adjustment circuit 11 is provided to compensate for the mismatch between the PMOS transistors M1 and M2. Referring to FIG. 2, the voltage adjustment circuit 11 comprises a comparator 22 and a path control circuit 23. The non-inverting input terminal (+) of the comparator 22 receives the output voltage Vo and the inverting input terminal (−) thereof receives the reference voltage Vref10. During the operation of the reference voltage generation circuit 1, the comparator 22 compares the output voltage Vo with the reference voltage Vref10 and generates a control signal S22 at its output terminal according to the comparison result of the above comparison. The path control circuit 23 comprises an inverter composed of a PMOS transistor Ma and an N-type MOS (NMOS) transistor Mb. The gate of the PMOS transistor Ma is coupled to the output terminal of the comparator 22 to receive the control signal S22, the source thereof is coupled to the voltage source VS to receive the supply voltage VDD, and the drain thereof is coupled to the output node Nout. The gate of the NMOS transistor Mb is coupled to the output terminal of the comparator 22 to receive the control signal S22, the drain thereof is coupled to the output node Nout, and the source thereof is coupled to the ground terminal GND.

When the output voltage Vo is less than the reference voltage Vref10 due to the mismatch between the PMOS transistors M1 and M2 (in the cases where m<1), the comparator 22 generates the control signal S22 with a low voltage level to turn on the PMOS transistor Ma, so that, there is a charge path P20 formed between the voltage source VS and the output node Nout. Thus, the output node Nout is charged by the charge path P20 to increase the current I1. Due to the virtual ground of the operational amplifier 20, the voltage V1 at the inverting input terminal is equal to the voltage V2 at the non-inverting input terminal. Based on the equal voltages V1 and V2, the resistors R2 and R3 with the same resistance value, and the operation of the current mirror circuit 21, the current I1 is increased and eventually equal to the current I2, which makes the output voltage Vo equal to the reference voltage Vref10. Thus, the output voltage Vo is eventually adjusted to the predetermined value.

When the output voltage Vo is larger than the reference voltage Vref10 due to the mismatch between the PMOS transistors M1 and M2 (in the cases where m>1), the comparator 22 generates the control signal S22 with a high voltage level to turn on the NMOS transistor Mb, so that, there is a discharge path P21 formed between the output node Nout and the ground terminal GND. Thus, the output node Nout is discharged by the discharge path P21 to decrease the current I1. Based on the equal voltages V1 and V2, the resistors R2 and R3 with the same resistance value, and the operation of the current mirror circuit 21, the current I1 is decreased and eventually equal to the current I2, which makes the output voltage Vo equal to the reference voltage Vref10. Thus, the output voltage Vo is eventually adjusted to the predetermined value.

According to the above embodiment, through the disposition of the resistors R2 and R3 and the operation of the voltage adjustment circuit 11, the output voltage Vo can be adjusted for compensating for the mismatch between the PMOS transistors M1 and M2, such that the reference voltage generation circuit 1 is insensitive to the mismatch induced by the process variations.

Figure 3:
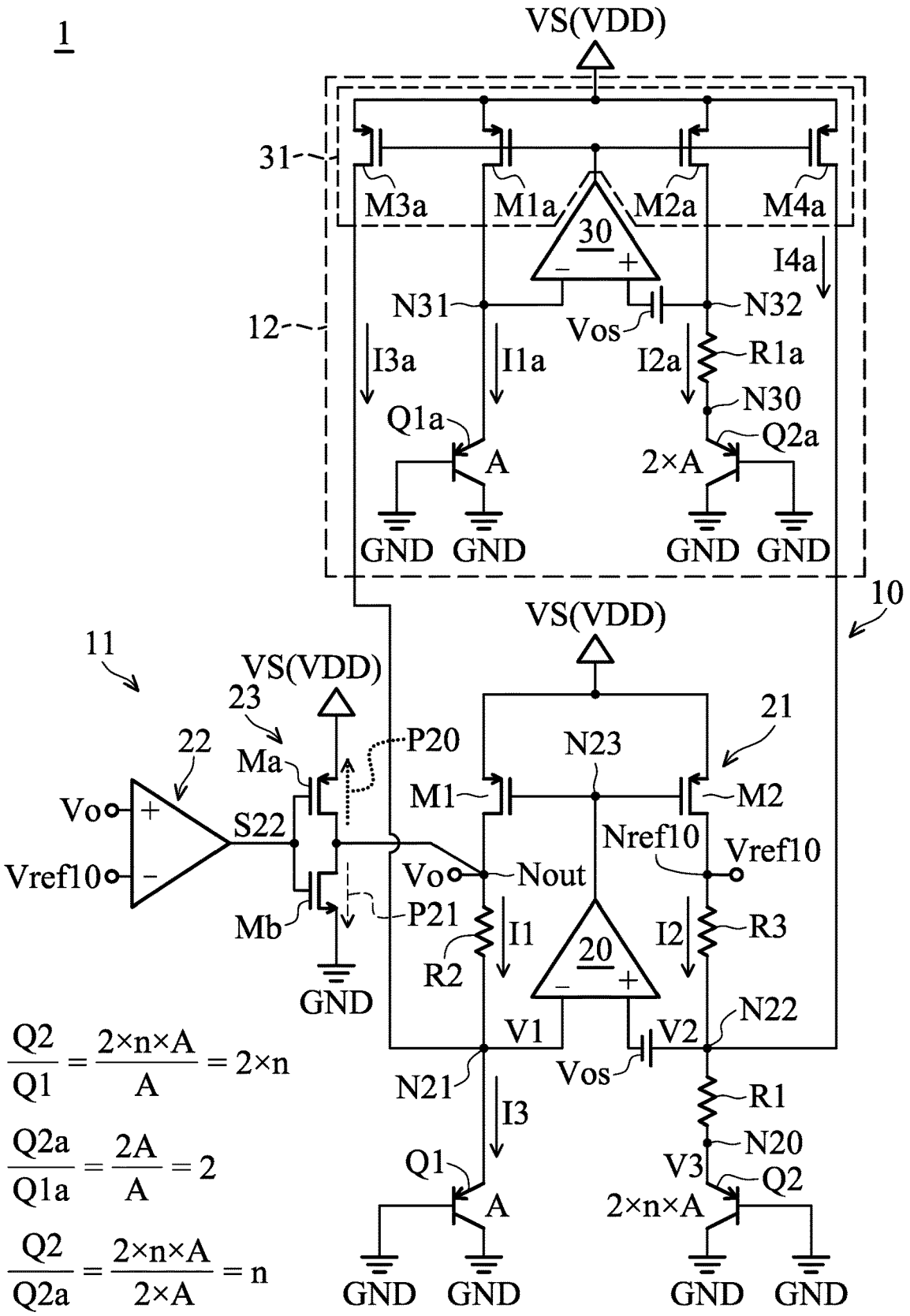
FIG. 3 shows another exemplary embodiment of a reference voltage generation circuit.

According to the structure of the reference voltage generation circuit 1, there is an operational amplifier 20. Usually, the offset voltage of an operational amplifier is in a range 1-10 mV. When the operational amplifier 20 has an offset voltage, the voltage output Vo may have up to 20% error. In order to eliminate the effect of the offset voltage, the reference voltage generation circuit 1 further comprises an offset current generation circuit 12, as shown in FIG. 3. In the following paragraphs, to discuss the operation of the offset current generation circuit 12 and the elimination of the offset voltage clearly, it is assumed that m is equal to 1 (m=1), and the operation related to the above adjustment of the output voltage Vo is omitted. Note that, in the embodiment of FIG. 3, the size of the bipolar transistor Q2 is 2×n times the size A of the bipolar transistor Q1 (the size of the bipolar transistor Q2 is represented by 2×n×A), that is, the size ratio of the bipolar transistors Q2 and Q1 is equal to 2×n, and the size ratio is represented by $$\frac{Q2}{Q1} = \frac{2 \times n \times A}{A} = 2 \times n$$

in FIG. 3. Moreover, the offset voltage of the operational amplifier 20 is represented by a voltage Vos at the non-inverting input terminal of the operational amplifier 20.

Referring to FIG. 3, the offset current generation circuit 12 comprises a pair of bipolar transistors Q1*a* and Q2*a*, a resistor R1*a*, an operational amplifier 30, and a current mirror circuit 31 composed of MOS transistors M1*a*-M4*a*. The base of the bipolar transistor Q1*a* is coupled to the ground terminal GND, the collector thereof is coupled to the ground terminal GND, and the emitter thereof is coupled to a node N31. The base of the bipolar transistor Q2*a* is coupled to the ground terminal GND, the collector thereof is coupled to the ground terminal GND, and the emitter thereof is coupled to a node N30. In the embodiment of FIG. 3, the size of the bipolar transistor Q1*a* is equal to the size A of the bipolar transistor Q1, and the size of the bipolar transistor Q2*a* is twice the size of the bipolar transistor Q1*a* (that is, the size of the bipolar transistor Q2*a* is equal to twice the size A of the bipolar transistor Q1, represented by 2×A). Thus, the size ratio of the bipolar transistor Q2*a* and the bipolar transistor Q1*a* is equal to 2 and is represented by $$\frac{Q2a}{Q1a} = \frac{2 \times A}{A} = 2$$

in FIG. 3. In other words, the size of the bipolar transistor Q2 is n times the size of the bipolar transistor Q2*a*. The size ratio of the bipolar transistor Q2*a* and the bipolar transistor Q1 is equal to n, and the size ratio is represented by $$\frac{Q2}{Q2a} = \frac{2 \times n \times A}{2 \times A} = n$$

in FIG. 3. The resistor R1*a* is coupled between a node N32 and the node N30. In the embodiment, the resistance value of the resistor R1*a* is equal to the resistance value of the resistor R1. The non-inverting input terminal (+) of the operational amplifier 30 is coupled to the node N32 and the inverting input terminal (−) thereof is coupled to the node N31. As shown in FIG. 3, the offset voltage of the operational amplifier 30 is represented by a voltage Vos at the non-inverting input terminal of the operational amplifier 30. In the embodiment, the MOS transistors M1*a*-M4*a* of the current mirror circuit are implemented by PMOS transistors. The gate of the PMOS transistor M1*a* is coupled to the output terminal of the operational amplifier 30, the source thereof is coupled to the voltage source VS, and the drain thereof is coupled to the node N31. The gate of the PMOS transistor M2*a* is coupled to the output terminal of the operational amplifier 30, the source thereof is coupled to the voltage source VS, and the drain thereof is coupled to the node N32. The gate of the PMOS transistor M3*a* is coupled to the output terminal of the operational amplifier 30, the source thereof is coupled to the voltage source VS, and the drain thereof is coupled to the node N21. The gate of the PMOS transistor M4*a* is coupled to the output terminal of the operational amplifier 30, the source thereof is coupled to the voltage source VS, and the drain thereof is coupled to the node N22. According to the structure of the current mirror circuit, the PMOS transistors M1*a*-M4*a* are controlled by the output at the output terminal of the operational amplifier 30.

In the cases where the offset voltages of the operational amplifier 20 is considered, since m is equal to 1, the current I3 is equal to the current through the resistor R1, and the current I3 is represented as:

$$I3 = [V_T \ln(2n) - V_{os}] \times \frac{1}{R_1} \quad \text{Equation (5)}$$

Through the operation of the current mirror circuit of the offset current generation circuit 12, the currents I1*a*, I2*a*, I3*a*, and I4*a* are equal. Thus, when the offset voltages of the operational amplifier 30 is considered, the current I3*a* is represented as:

$$I3a = [V_T \ln 2 - V_{os}] \times \frac{1}{R_{1a}} \quad \text{Equation (6)}$$

Referring to FIG. 3, the current I1 is represented as:

$$I1 = I3 - I3a \quad \text{Equation (7).}$$

Since the resistance value of the resistor R1*a* is equal to the resistance value of the resistor R1, Equation (7) is re-written, based on Equation (5)~Equation (7), as:

$$I1 = V_T \ln(n) \times \frac{1}{R_1} \quad \text{Equation (8)}$$

According to the current I4 and the resistor R2, the output voltage Vo is represented as:

$$Vo = V_{BE1} + I1 \times R2 = V_{BE1} + \frac{V_T}{R1} \ln(n) \times R2 \quad \text{Equation (9)}$$

It can be found that Equation (9) is the same as Equation (4), which means that the offset voltage Vos of the operational amplifier 20 is cancelled through the generation of the current I3*a* (offset current). According to the embodiment of FIG. 3, through the operations of the voltage adjustment circuit 11 and the offset current generation circuit 12, the mismatch between the PMOS transistors M1 and M2 is compensated for, and the offset voltage Vos of the operational amplifier 20 is eliminated, which enhance the stability of the output voltage Vo.

Figure 4:
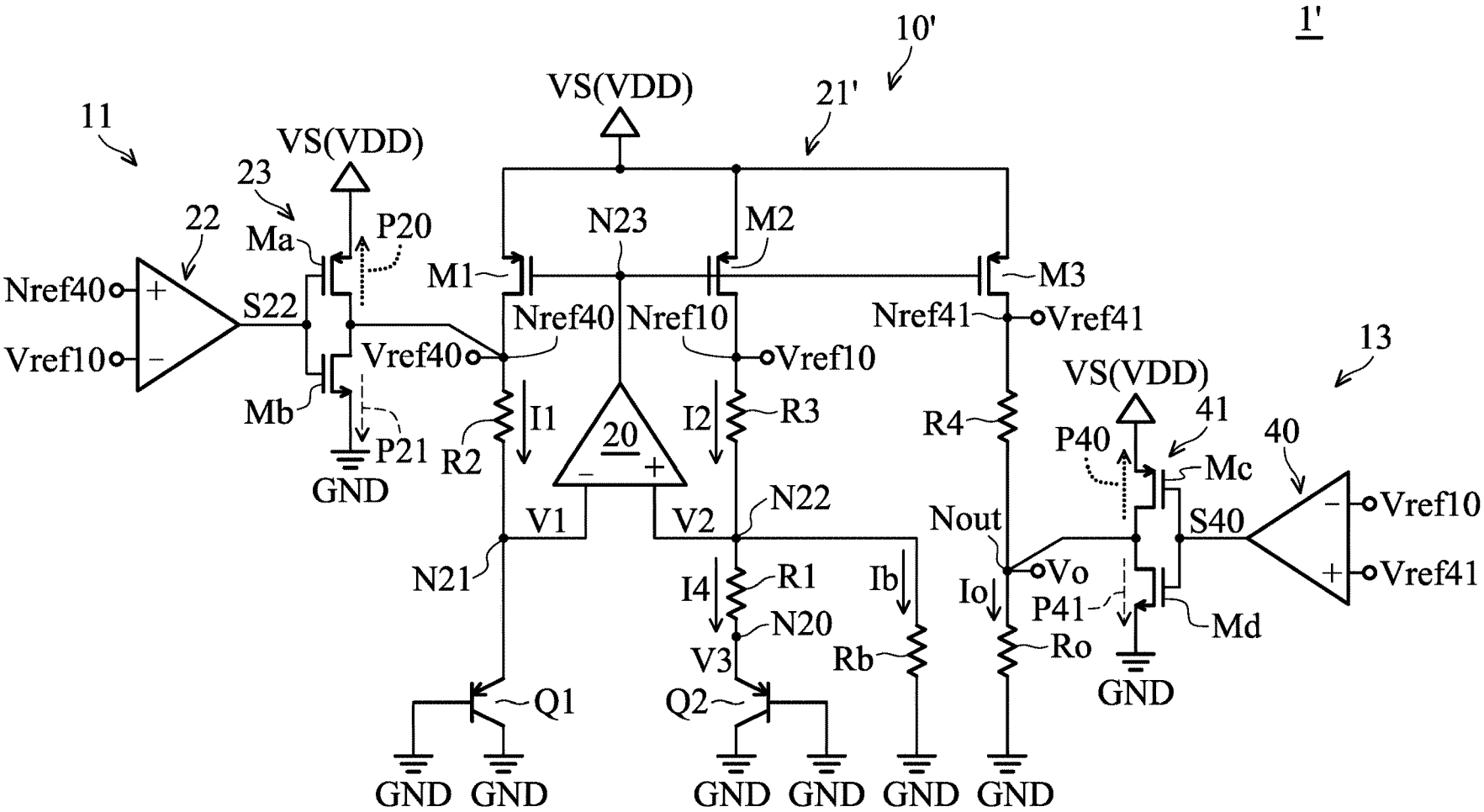
FIG. 4 shows another exemplary embodiment of a reference voltage generation circuit.

In the above embodiments, the reference voltage generation circuit 1 generates the output voltage Vo which is larger than 1V, such as 1.25V. In some applications, a stable reference voltage which is less than 1V is required. Thus, according to other embodiments, a reference voltage generation circuit is provided to generate an output voltage which is less than 1V, such as 0.5V. Referring to FIG. 4, a reference voltage generation circuit 1' comprises a bandgap reference circuit 10', a voltage adjustment circuit 11, and a voltage adjustment circuit 13. The bandgap reference circuit 10' comprises a pair of bipolar transistors Q1 and Q2, resistors R1~R4, Rb and Ro, an operational amplifier 20, and a current mirror circuit 21', and the current mirror circuit 21' comprises PMOS transistors M1~M3. Referring to FIGS. 2 and 4, the connections of the bipolar transistors Q1 and Q2, the resistors R1~R3, the operational amplifier 20, and the PMOS transistors M1 and M2 in the embodiment of FIG. 4 are similar to those in the embodiment of FIG. 2, and, thus, the description related to the connections of these elements is omitted here. Note that, in FIG. 4, the joint node between the PMOS transistor M1 and the resistor R2 is represented as Nref40 instead of the node Nout in FIG. 2, and the voltage at the joint node therebetween is referred to as a reference voltage Vref40 instead of the output voltage Vo in FIG. 2. Moreover, the structure of the voltage adjustment circuit 11 in the embodiment of FIG. 4 is similar to that in the embodiment of FIG. 2, and, thus, the related description is also omitted. In the following, the connections of the elements not shown in FIG. 2 will be described.

Referring to FIG. 4, the resistor Rb is coupled between the node N22 and the ground terminal GND. The resistor Ro is coupled to an output node Nout and the ground terminal GND. The resistor R4 is coupled between a reference node Nref41 and the output node Nout. In the embodiment, the resistance value of the resistor R4 is equal to the resistance values of the resistors R2 and R3. The gate of the PMOS transistor M3 is coupled to the node N23, the source thereof is coupled to the voltage source VS, and the drain thereof is coupled to the reference node Nref41.

In the embodiment of FIG. 4, the operations of the bipolar transistors Q1 and Q2, the resistors R1~R3, the operational amplifier 20, and the PMOS transistors M1 and M2 are the same as those in the embodiment of FIG. 2, and the related description is omitted here. Based on the operations of the bipolar transistors Q1 and Q2, the resistors R1~R3, the operational amplifier 20, and the PMOS transistors M1 and M2, a current Ib flowing through the resistor Rb is generated and represented as:

$$Ib = \frac{V2}{Rb} = \frac{V1}{Rb} \quad \text{Equation (10)}$$

wherein, since V1 has a negative temperature coefficient, the current Ib also has a negative temperature coefficient. In the embodiment, the current I2 is represented as:

$$I2 = I4 + Ib \quad \text{Equation (11)}$$

wherein, the current I4 follows through the resistor R1 and has a positive temperature coefficient. Thus, in the embodiment, the current I2 has a zero temperature coefficient. Through the current mirror operation of the PMOS transistors M1 and M3 and the voltage division of the resistors R4 and Ro, the output voltage Vo is generated at the output node Nout.

In ideal cases, there is no mismatch between the PMOS transistors M1 and M2 (that is, m=1) and between the PMOS transistors M2 and M3. However, in some situations, mismatch may occur between the PMOS transistors M1 and M2 (m>1 or m<1), and mismatch may occur between the PMOS transistors M2 and M3, which causes that the output voltage Vo is not equal to a predetermined value, such as 0.5V. As described above, the mismatch between the PMOS transistors M1 and M2 can be compensated for through the operation of the voltage adjustment circuit 11. In the embodiment, the reference voltage generation circuit 1' further comprises the voltage adjustment circuit 13 to compensate for the mismatch between the PMOS transistors M2 and M3. Referring to FIG. 4, the voltage adjustment circuit 13 comprises a comparator 40 and a path control circuit 41. The non-inverting input terminal (+) of the comparator 40 receives the reference voltage Vref41 and the inverting input terminal (−) thereof receives the reference voltage Vref10. During the operation of the reference voltage generation circuit 1', the comparator 40 compares the reference voltage Vref41 with the reference voltage Vref10 and generates a control signal S40 at its output terminal according to the comparison result of the above comparison. The path control circuit 41 comprises an inverter composed of a PMOS transistor Mc and an NMOS transistor Md. The gate of the PMOS transistor Mc is coupled to the output terminal of the comparator 40 to receive the control signal S40, the source thereof is coupled to the voltage source VS to receive the supply voltage VDD, and the drain thereof is coupled to the output node Nout. The gate of the NMOS transistor Md is coupled to the output terminal of the comparator 40 to receive the control signal S40, the drain thereof is coupled to the output node Nout, and the source thereof is coupled to the ground terminal GND.

When the reference voltage Vref41 is less than the reference voltage Vref10 due to the mismatch between the MOS transistors M2 and M3, the comparator 40 generates the control signal S40 with a low voltage level to turn on the PMOS transistor Mc, so that, there is a charge path P40 formed between the voltage source VS and the output node Nout. Thus, the reference node Nref41 is charged by the charge path P40 to increase the current Io. Based on the resistors R3 and R4 with the same resistance value and the operation of the current mirror circuit 21', the current Io is increased and eventually equal to the current I2, which makes the reference voltage Vref41 equal to the reference voltage Vref10. Through the voltage division, the output voltage Vo is eventually equal to the predetermined value with the increment of the current Io.

When the reference voltage Vref41 is larger than the reference voltage Vref10 due to the mismatch between the MOS transistors M2 and M3, the comparator 40 generates the control signal S40 with a high voltage level to turn on the NMOS transistor Md, so that, there is a discharge path P41 formed between the output node Nout and the ground terminal GND. Thus, the reference node Nref41 is discharged by the discharge path P41 to decrease the current Io. Based on the resistors R3 and R4 with the same resistance value and the operation of the current mirror circuit 21', the current Io is decreased and eventually equal to the current I2, which makes the reference voltage Vref41 equal to the reference voltage Vref10. Through the voltage division, the output voltage Vo is eventually equal to the predetermined value with the decrement of the current Io.

According to the above embodiment, through the disposition of the resistors R2~R4 and the operations of the voltage adjustment circuit 11 and 13, the output voltage Vo, which is less than 1V, can be adjusted for compensating for the mismatch between the PMOS transistors M1 and M2 and between the PMOS transistors M2 and M3, such that the reference voltage generation circuit 1' is insensitive to the mismatch induced by the process variations.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A reference voltage generation circuit for generating an output voltage, comprising:

a bandgap reference circuit generating the output voltage at an output node and a reference voltage, wherein the bandgap reference circuit comprises:

a first metal-oxide-semiconductor (MOS) transistor having a gate, a source coupled to a voltage source, and drain directly connected to the output node; and a first resistor having a first terminal directly connected to the output node and a second terminal coupled to a ground terminal; and a voltage adjustment circuit, coupled to the bandgap reference circuit, receiving the output voltage and the reference voltage, comparing the output voltage with the reference voltage to generate a comparison result, and adjusting the output voltage according to the comparison result.

2. The reference voltage generation circuit as claimed in claim 1, wherein the bandgap reference circuit comprises:

a first bipolar transistor having a base coupled to a ground terminal, a collector coupled to the ground terminal, and an emitter coupled to a first node;

a second bipolar transistor having a base coupled to the ground terminal, a collector coupled to the ground terminal, and an emitter coupled to a second node;

a second resistor coupled between the second node and a third node;

a third resistor having a first terminal directly connected to a reference node and a second terminal directly connected to the third node;

a second MOS transistor having a gate coupled to a fourth node, a source coupled to the voltage source, and a drain directly connected to the reference node; and an operational amplifier having a non-inverting input terminal directly connected to the third node, an inverting input terminal directly connected to the first node, and an output terminal coupled to the fourth node, wherein the second terminal of the first resistor is directly connected to the first node, and the gate of the first MOS transistor is coupled to the fourth node, and wherein in response to the voltage source receiving a supply voltage, the reference voltage generation circuit operates to generate the output voltage and the reference voltage at the output node and the reference node respectively.

3. The reference voltage generation circuit as claimed in claim 1, wherein the voltage adjustment circuit comprising:

a comparator having a non-inverting input terminal receiving the output voltage, an inverting input terminal receiving the reference voltage, and an output terminal generating a control signal to indicate the comparison result; and a path control circuit coupled between a voltage source and a ground terminal and controlled by the control signal to provide a charge path or a discharge path to the output node.

4. The reference voltage generation circuit as claimed in claim 1, further comprising:

an offset current generation circuit generating an offset current to the bandgap reference circuit for eliminating an offset voltage of a first operational amplifier of the bandgap reference circuit.

5. The reference voltage generation circuit as claimed in claim 3, wherein in response to the output voltage being greater than the reference voltage, the path control circuit provides the discharge path to the output node according to the control signal, and in response to the output voltage being less than the reference voltage, the path control circuit provides the charge path to the output node according to the control signal.

6. The reference voltage generation circuit as claimed in claim 3, wherein path control circuit comprises:

a first MOS transistor having a gate receiving the control signal, a source coupled to the voltage source, and a drain coupled to the output node; and a second MOS transistor having a gate receiving the control signal, a drain coupled to the output node, and a source coupled to the ground terminal.

7. The reference voltage generation circuit as claimed in claim 4, wherein the bandgap reference circuit further comprises a pair of first bipolar transistors coupled between the first operational amplifier and a ground terminal, and a size ratio of the pair of first bipolar transistors is equal to 2×n, n is a positive integer, and wherein the offset current generation circuit comprises a second operation amplifier and a pair of second bipolar transistors coupled between the second operational amplifier and the ground terminal, and a size ratio of the pair of second bipolar transistors is equal to 2.

8. The reference voltage generation circuit as claimed in claim 7, wherein one of the pair of the second bipolar transistors has a base coupled to the ground terminal, a collector coupled to the ground terminal, and an emitter coupled to a first node, wherein the other of the pair of second bipolar transistors has a base coupled to the ground terminal, a collector coupled to the ground terminal, and an emitter coupled to a second node, wherein the offset current generation circuit further comprises a resistor, which is coupled between the second node and a third node, and a current mirror circuit, wherein the second operational amplifier has a non-inverting input terminal coupled to the third node, an inverting input terminal coupled to the first node, and an output terminal, and wherein the current mirror current is coupled between a voltage source and the pair of second bipolar transistors and controlled by an output at the output terminal of the second operational amplifier to generate the offset current.

9. A reference voltage generation circuit for generating an output voltage at an output node, comprising:

a first bipolar transistor having a base coupled to a ground terminal, a collector coupled to the ground terminal, and an emitter coupled to a first node;

a second bipolar transistor having a base coupled to the ground terminal, a collector coupled to the ground terminal, and an emitter coupled to a second node;

a first resistor coupled between the second node and a third node;

a second resistor having a first terminal directly connected to the output node and a second terminal directly connected to the first node;

a third resistor coupled between a reference node and the third node;

a first operational amplifier having a non-inverting input terminal coupled to the third node, an inverting input terminal directly connected to the first node, and an output terminal;

a first current mirror circuit coupled to a voltage source and further directly connected to the output node and the reference node; and a voltage adjustment circuit, coupled to the output node and the reference node to receive the output voltage and a reference voltage which is generated at the reference node respectively, comparing the output voltage with the reference voltage to generate a comparison result, and adjusting the output voltage according to the comparison result.

10. The reference voltage generation circuit as claimed in claim 9, wherein the voltage adjustment circuit comprising:

a comparator having a non-inverting input terminal receiving the output voltage, an inverting input terminal receiving the reference voltage, and an output terminal generating a control signal to indicate the comparison result; and a path control circuit coupled between the voltage source and the ground terminal and controlled by the control signal to provide a charge path or a discharge path to the output node.

11. The reference voltage generation circuit as claimed in claim 9, further comprising:

a third bipolar transistor having a base coupled to the ground terminal, a collector coupled to the ground terminal, and an emitter coupled to a fourth node;

a fourth bipolar transistor having a base coupled to the ground terminal, a collector coupled to the ground terminal, and an emitter coupled to a fifth node;

a fourth resistor coupled between the fifth node and a sixth node;

a second operational amplifier having a non-inverting input terminal coupled to the six node, an inverting input terminal coupled to the fourth node, and an output terminal; and a second mirror circuit coupled to the voltage source and further coupled to the fourth node and the sixth node wherein the second mirror circuit generates an offset current to the first node for eliminating an offset voltage of the first operational amplifier.

12. The reference voltage generation circuit as claimed in claim 9, wherein the third resistor has a first terminal directly connected to the reference node and a second terminal directly connected to the third node, and the non-inverting input terminal of the first operational amplifier is directly connected to the third node.

13. The reference voltage generation circuit as claimed in claim 10, wherein in response to the output voltage being greater than the reference voltage, the path control circuit provides the discharge path to the output node according to the control signal, and in response to the output voltage being less than the reference voltage, the path control circuit provides the charge path to the output node according to the control signal.

14. The reference voltage generation circuit as claimed in claim 10, wherein path control circuit comprises:

a first metal-oxide-semiconductor (MOS) transistor having a gate receiving the control signal, a source coupled to the voltage source, and a drain coupled to the output node; and a second MOS transistor having a gate receiving the control signal, a drain coupled to the output node, and a source coupled to the ground terminal.

15. The reference voltage generation circuit as claimed in claim 11, wherein a size ratio of the second bipolar transistor and the first bipolar transistor is equal to 2×n, n is a positive integer, and wherein a size ratio of the second bipolar transistor and the fourth bipolar transistor is equal to n.

16. A reference voltage generation circuit for generating an output voltage at an output node, comprising:

a first bipolar transistor having a base coupled to a ground terminal, a collector coupled to the ground terminal, and an emitter coupled to a first node;

a second bipolar transistor having a base coupled to the ground terminal, a collector coupled to the ground terminal, and an emitter coupled to a second node;

a first resistor coupled between the second node and a third node;

a second resistor coupled to a first reference node and the first node;

a third resistor coupled to a second reference node and the third node;

an operational amplifier having a non-inverting input terminal coupled to the third node, an inverting input terminal coupled to the first node, and an output terminal;

a fourth resistor coupled between the third node and the ground terminal;

a fifth resistor coupled between a third reference node and the output node;

a sixth resistor coupled between the output node and the ground terminal;

a current mirror circuit coupled to a voltage source and further coupled to the first, second, and third reference nodes;

a first voltage adjustment circuit, coupled to the first reference node and the second reference node to receive a first reference voltage and a second reference voltage respectively, comparing the first reference voltage with the second reference voltage to generate a first comparison result, and adjusting the first reference voltage according to the first comparison result; and a second voltage adjustment circuit, coupled to the second reference node and the third reference node to receive the second reference voltage and a third reference voltage respectively, comparing the second reference with the third reference voltage to generate a second comparison result, and adjusting the output voltage according to the second comparison result.

17. The reference voltage generation circuit as claimed in claim 16, wherein the first voltage adjustment circuit comprising:

a comparator having a non-inverting input terminal receiving the first reference voltage, an inverting input terminal receiving the second reference voltage, and an output terminal generating a control signal to indicate the first comparison result; and a path control circuit coupled between the voltage source and the ground terminal and controlled by the control signal to provide a charge path or a discharge path to the first reference node.

18. The reference voltage generation circuit as claimed in claim 16, wherein the second voltage adjustment circuit comprising:

a comparator having a non-inverting input terminal receiving the third reference voltage, an inverting input terminal receiving the second reference voltage, and an output terminal generating a control signal to indicate the second comparison result; and a path control circuit coupled between the voltage source and the ground terminal and controlled by the control signal to provide a charge path or a discharge path to the output node.

19. The reference voltage generation circuit as claimed in claim 17, wherein in response to the first reference being greater than the second voltage, the path control circuit provides the discharge path to the first reference node according to the control signal, and in response to the first reference voltage being less than the second reference voltage, the path control circuit provides the charge path to the first reference node according to the control signal.

20. The reference voltage generation circuit as claimed in claim 17, wherein path control circuit comprises:

a first metal-oxide-semiconductor (MOS) transistor having a gate receiving the control signal, a source coupled to the voltage source, and a drain coupled to the first reference node; and a second MOS transistor having a gate receiving the control signal, a drain coupled to the first reference node, and a source coupled to the ground terminal.

21. The reference voltage generation circuit as claimed in claim 18, wherein in response to the third reference voltage being greater than the second reference voltage, the path control circuit provides the discharge path to the output node according to the control signal, and in response to the third reference voltage being less than the second reference voltage, the path control circuit provides the charge path to the output node according to the control signal.

22. The reference voltage generation circuit as claimed in claim 18, wherein path control circuit comprises:

a first metal-oxide-semiconductor (MOS) transistor having a gate receiving the control signal, a source coupled to the voltage source, and a drain coupled to the output node; and a second MOS transistor having a gate receiving the control signal, a drain coupled to the output node, and a source coupled to the ground terminal.

* * * * *